US007543442B2

(12) United States Patent
Derenes et al.

(10) Patent No.: US 7,543,442 B2
(45) Date of Patent: Jun. 9, 2009

(54) TURBOJET ENGINE COMPRISING A CONNECTOR ARM FOR ANCILLARY SYSTEMS, AND THE CONNECTOR ARM FOR ANCILLARY SYSTEMS

(75) Inventors: Jacky Derenes, Moissy-Cramayel (FR); Georges Mazeaud, Yerres (FR)

(73) Assignee: Snecma, Paris (FR)

( * ) Notice: Subject to any disclaimer, the term of this patent is extended or adjusted under 35 U.S.C. 154(b) by 756 days.

(21) Appl. No.: 11/031,004

(22) Filed: Jan. 10, 2005

(65) Prior Publication Data

US 2005/0247043 A1 Nov. 10, 2005

(30) Foreign Application Priority Data

Jan. 12, 2004 (FR) ..... 04 00221

(51) Int. Cl.
*F02C 7/00* (2006.01)

(52) U.S. Cl. ..... 60/226.1; 60/796

(58) Field of Classification Search ..... 60/226.1, 60/796, 296, 298, 802, 415; 415/191, 208.2, 415/210.1, 211.2
See application file for complete search history.

(56) References Cited

U.S. PATENT DOCUMENTS

| | | | | |
|---|---|---|---|---|
| 3,841,089 | A * | 10/1974 | Clark | 60/39.094 |
| 4,987,736 | A | 1/1991 | Ciokajlo et al. | |
| 5,174,110 | A * | 12/1992 | Duesler et al. | 60/226.1 |
| 5,313,780 | A * | 5/1994 | Williams et al. | 60/39.08 |
| 5,746,574 | A | 5/1998 | Czachor et al. | |
| 2002/0076320 | A1 | 6/2002 | Glover et al. | |
| 2003/0019205 | A1 | 1/2003 | Rice et al. | |
| 2005/0022501 | A1 * | 2/2005 | Eleftheriou et al. | 60/226.1 |

FOREIGN PATENT DOCUMENTS

EP 0 601 864 A1 6/1994

* cited by examiner

*Primary Examiner*—Michael Cuff
*Assistant Examiner*—Phutthiwat Wongwian
(74) *Attorney, Agent, or Firm*—Oblon, Spivak, McClelland, Maier & Neustadt, P.C.

(57) ABSTRACT

A turbofan jet engine includes an outer fan duct, an inner fan duct, fluid-conveying ancillaries located outside the outer fan duct, fluid-conveying ancillaries located inside the inner fan duct. At least one removable modular arm forming a connection for ancillaries is arranged between the outer fan duct and the inner fan duct. The removable arm provides a connection of ancillaries outside the outer fan duct to ancillaries inside the inner fan duct.

7 Claims, 4 Drawing Sheets

TURBOJET ENGINE COMPRISING A CONNECTOR ARM FOR ANCILLARY SYSTEMS, AND THE CONNECTOR ARM FOR ANCILLARY SYSTEMS

The invention concerns a turbofan jet engine comprising an outer fan duct.

A turbofan jet engine functionally comprises an air intake, a fan, a compressor, a combustion chamber, a turbine and an exhaust nozzle. These various elements are contained in casings.

Generally, the engine is attached to the aircraft structure by two cases: a so-called intermediate case positioned just downstream of the fan case, and an exhaust case at the rear of the engine.

When a turbofan jet engine is positioned for example on the fuselage of an aircraft, generally in rear position, the secondary air stream must be contained and guided along the turbojet engine as far as the exhaust case. For such guiding, a so-called outer fan duct is placed between the intermediate case and a mounting ring connected to the exhaust case by a series of connecting rods. This outer fan duct ensures a twofold function: to contain and guide the secondary air stream firstly, and secondly to take up the thrust forces.

The annular secondary air stream is guided on its inner surface via an inner duct called an inner fan duct positioned globally concentrically to the outer fan duct between the inner base of the intermediate case arms and the exhaust case.

The various fluids required for the functioning of the turbofan jet engine, such as fuel, oil and the control fluids for accessory engine parts must be conveyed from outside the turbofan jet engine, in particular outside of the outer fan duct, towards its core i.e. the enclosure defined by the inner fan duct containing the compressor, the combustion chamber, the turbine and the exhaust nozzle. This conveying is ensured by lines commonly called the ancillaries. The invention particularly concerns the passing of ancillaries between the outer fan duct and the inner fan duct.

In FIG. 1, which partly shows the parts of the casing of a turbojet engine 1 of the prior art, an intermediate case 2 can be seen and a mounting ring 3. The ring is fixed to the exhaust case, not shown, by connecting rods. An outer fan duct 4 can be seen mounted between the intermediate case 2 and ring 3, comprising access doors 5 distributed around its circumference permitting access to the enclosure which it defines, and in particular to the inner fan duct. It is through these doors 5 that the ancillaries 7 are mounted.

With reference to FIG. 2, the inner fan duct comprises a plurality of panel supporting plates 6 extending longitudinally between the base of the intermediate case arms and the exhaust case. They are intended to support panels which are to define the surface of the inner fan duct. The ancillaries 7 are brought to and fixed to these panel supporting plates 6, to which the operator has access via access doors 5 of the outer fan duct 4, on a block projecting radially from plates 6. On this block 8, between the outer fan duct 4 and inner fan duct, a shaped jacket is mounted encasing the ancillaries 7 to ensure their protection and the proper flow of the gas stream. The mounting of the shaped jacket is also made via doors 5. These can then be closed.

Mounting of the ancillaries such as just described gives rise to numerous drawbacks. It is most time-consuming since the ancillaries must be mounted one by one on the block in a precise mounting order. Access to the inner fan duct via the doors of the outer fan duct is also unpractical. Maintenance or dismounting entails the same disadvantages as for mounting.

The present invention sets out to simplify the mounting, dismounting and maintenance of the ancillaries positioned between the outer fan duct and the inner fan duct of a turbojet engine.

According to the invention, a turbofan jet engine comprising an outer fan duct, an inner fan duct, fluid-conveying ancillaries positioned outside the outer fan duct, and fluid-conveying ancillaries positioned inside the inner fan duct is characterized by the fact that at least one removable modular arm forming an ancillary connection is arranged between said outer duct and said inner duct.

With the invention, the connection of the ancillaries outside the outer fan duct to the ancillaries inside the inner fan duct is simply achieved by means of a removable modular arm which is easy to mount and dismount. Since it is modular, the arm forms a whole consisting of a predefined assembly of standard elements; by removable is meant that the arm can be removed, in its modular assembly.

The arm can also be calibrated for various applications or for different turbojet engines.

Preferably, since the inner fan duct comprises panels and longitudinal plates supporting the panels, at least one panel-supporting longitudinal plate comprises a receiver bedplate for a removable modular arm.

According to another characteristic, the outer fan duct comprises at least one orifice for passing a removable modular arm.

According to another characteristic, the outer fan duct comprises tubing elements, including outer connection means to the ancillaries, and intended to be inserted in channels opening onto the outer surface of the bedplate.

Advantageously, in this case, the channels also open onto at least one different surface of the bedplate and comprise means for connection to the ancillaries.

Advantageously, the outer surface of the bedplate comprises a cut-out to receive the modular arm and in which the channels are bored.

As intermediate product the invention concerns a removable modular arm for the turbojet engine presented above, comprising a metal sheet pierced with orifices for passing calibrated tubing elements, calibrated tubing elements and a shaped jacket adapting to the metal sheet.

Preferably, the tubing elements, at one of their ends, comprise connection means to the ancillaries.

Preferably, the tubing elements, at one of their ends, comprise an O-ring seal.

Preferably the metal sheet comprises a recess on which the orifices are bored, that is intended to be fitted into the shaped jacket.

The invention will be more readily understood with the help of the following description of the preferred embodiment of the turbojet engine and its modular arm for the connection of ancillaries, with reference to the appended drawings in which.

Figure 5:
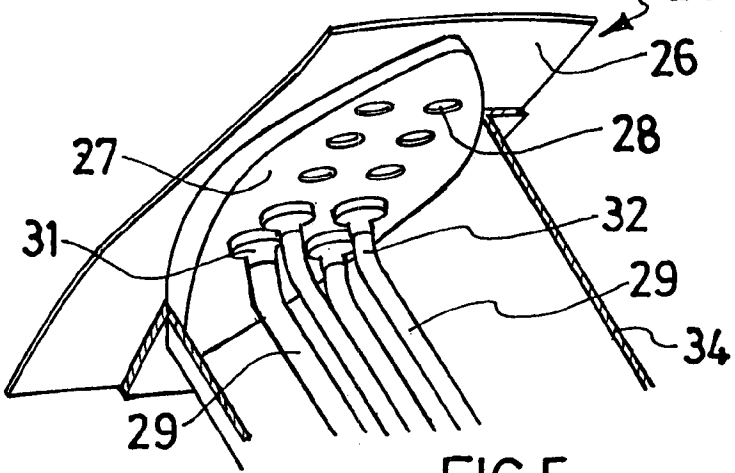
Figure 4:
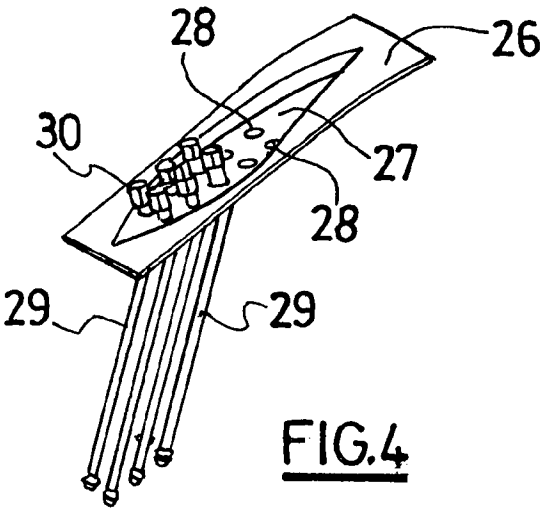
Figure 6:
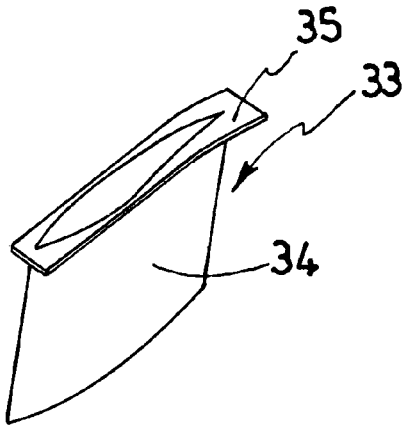
Figure 7:
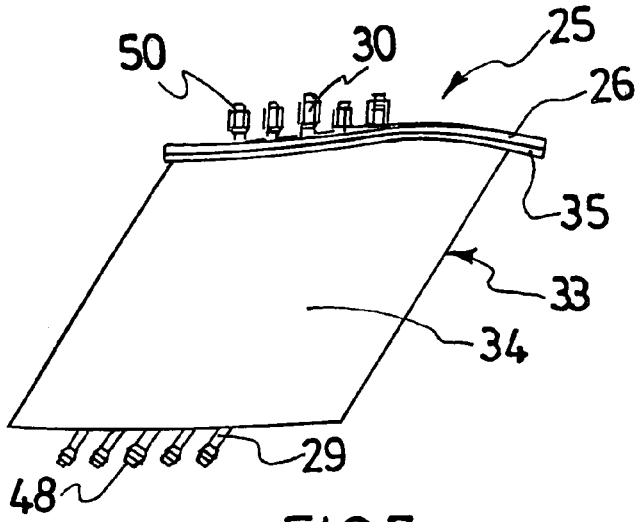
Figure 8:
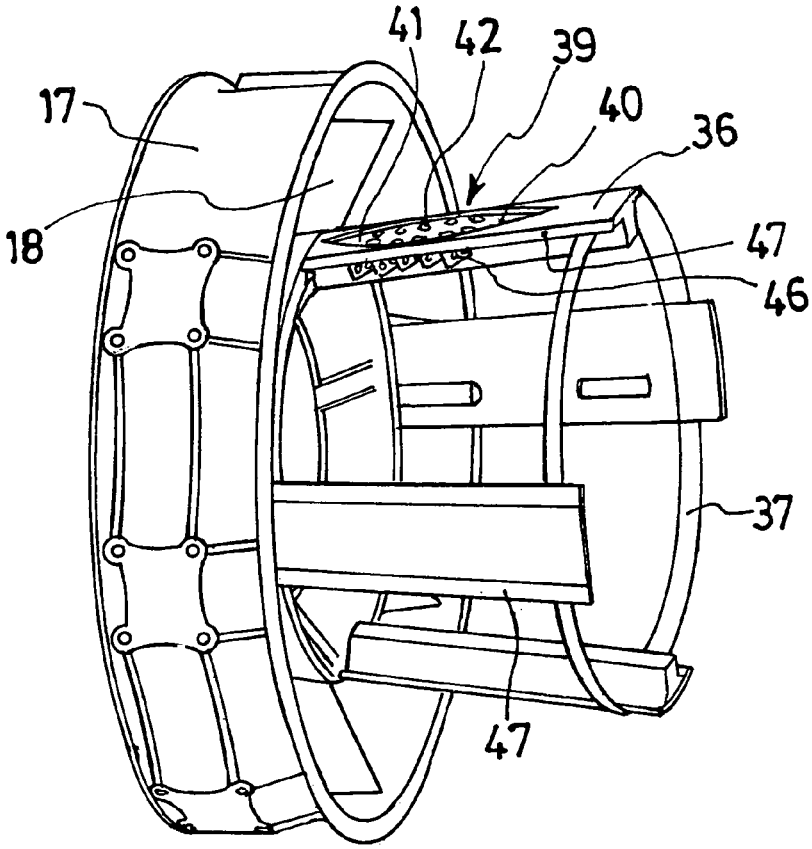
Figure 9:
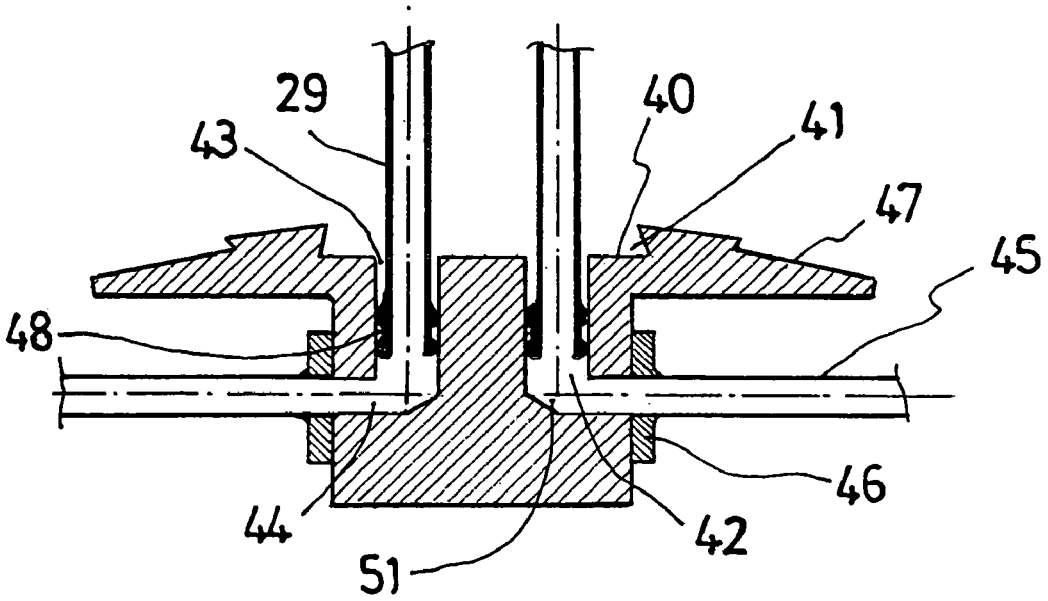
Figure 10:
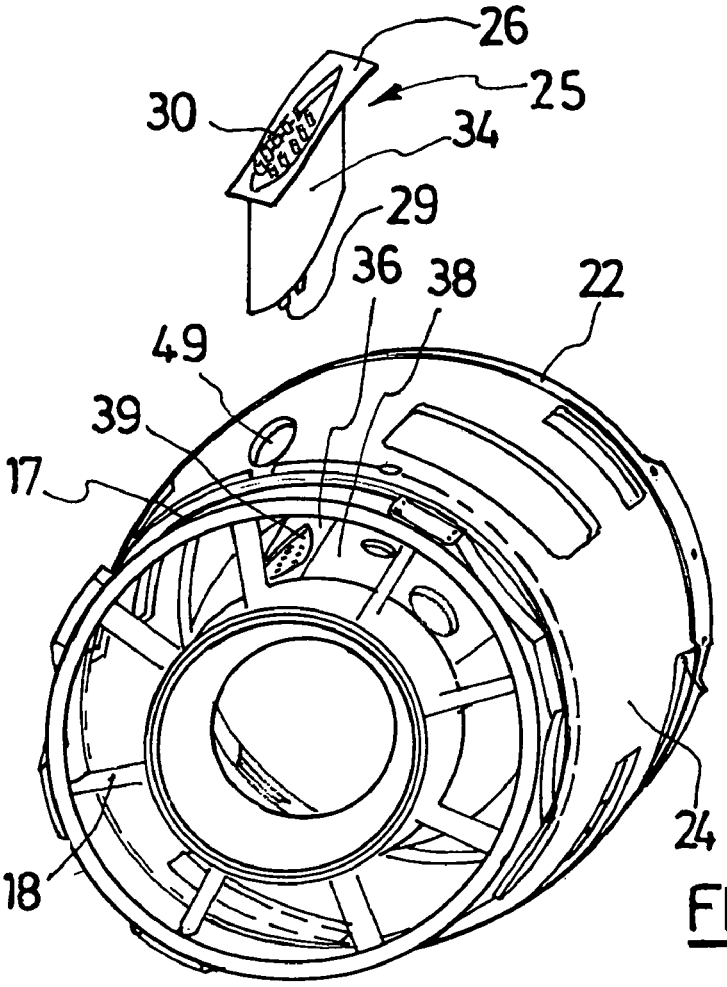

FIG. 4 is a schematic, perspective view of part of the modular arm of the invention, FIG. 5 is a part cross-section schematic giving a perspective underside view of the modular arm of the invention, FIG. 6 is a schematic, perspective view of another part of the modular arm of the invention, FIG. 7 is a profile view of the modular arm of the invention, FIG. 8 is a schematic, perspective view of the panel supports of the inner fan duct of the turbojet engine of the invention, FIG. 9 is a cross-section view of a panel support for the inner fan duct of a turbojet engine in which the tubing elements of the modular arm of the invention are inserted, and FIG. 10 is a schematic perspective view of the turbojet engine of the invention.

Figure 1:
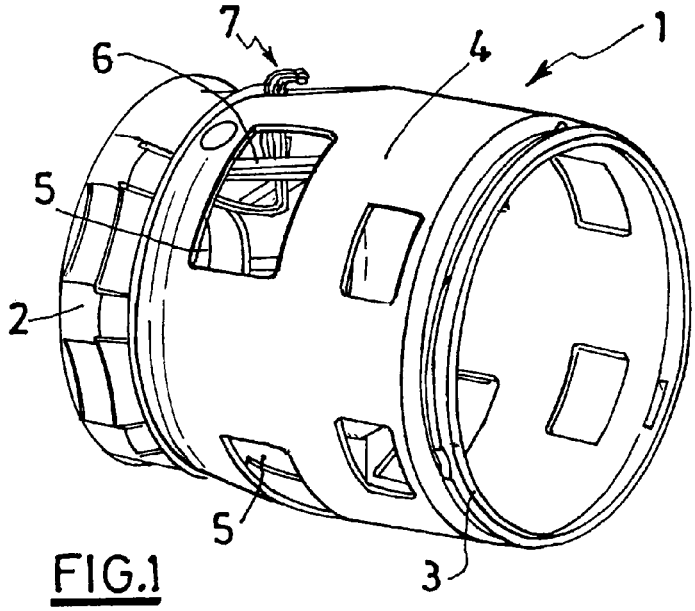
FIG.1 PRIOR ART
FIG. 1 is a schematic, perspective view of a turbojet engine casing of the prior art.
Figure 2:
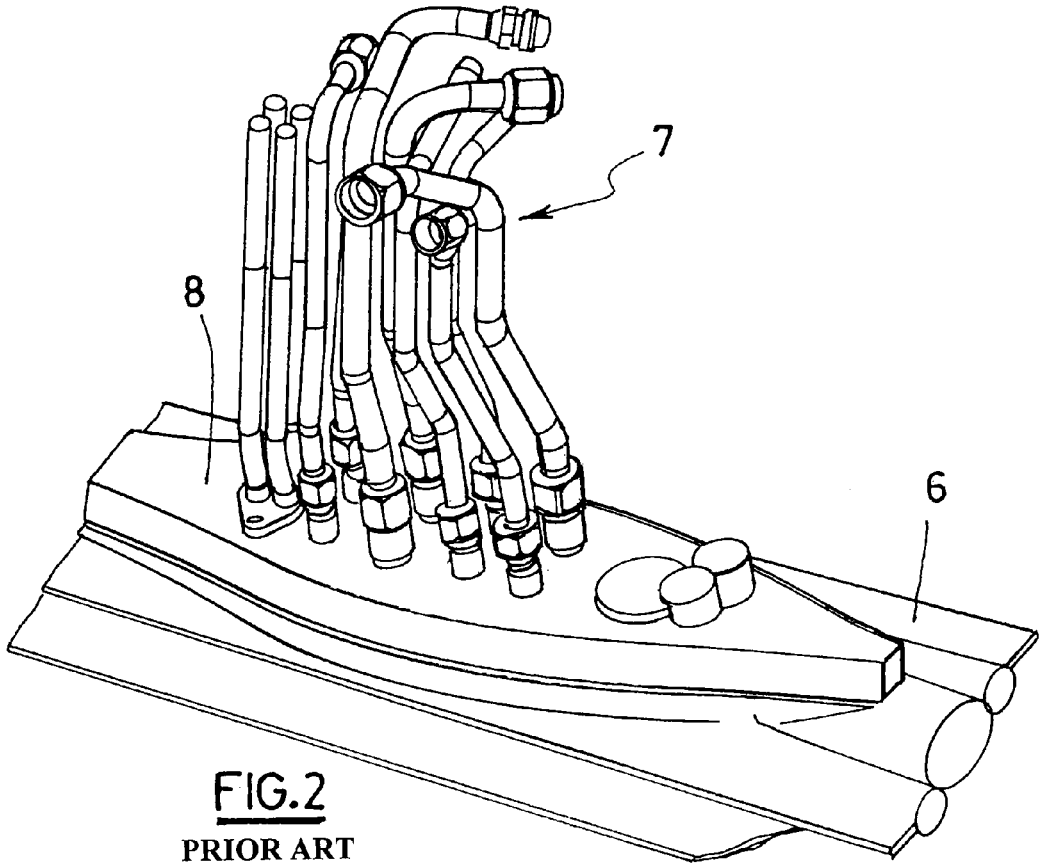
FIG.2 PRIOR ART
FIG. 2 is a schematic, perspective view of the ancillaries mounted on a supporting plate of an inner fan duct of the prior art.
Figure 3:
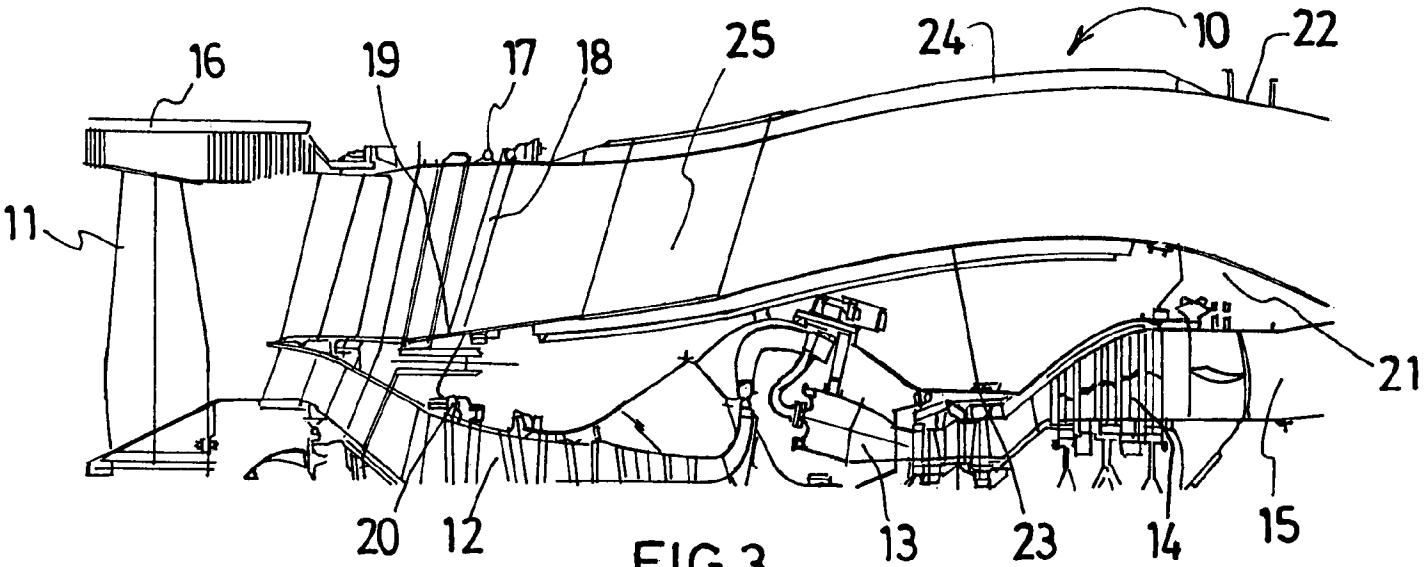
FIG. 3 is a profile, section view of the turbojet engine of the invention.

With reference to FIG. 3, the turbojet engine 10 of the invention, from upstream to downstream in the direction of the gas stream, comprises an air intake, a fan 11, a compressor 12, a combustion chamber 13, a turbine 14 and an exhaust duct 15. The fan is contained in a fan case 16, downstream of which an intermediate case 17 is mounted supported by arms 18 resting on an annular inner base 19 extending around the compressor case 20. The duct 15 is contained in an exhaust case 21. A mounting ring 22, intended to be fixed to a turbojet engine mount, is fixed to the exhaust case 21 via connecting rods, not shown.

Between the annular internal base 19 and the exhaust case 21 there is an inner fan duct 23 which encases the core of the turbojet engine 10 for the purpose of containing and guiding the secondary air stream flowing outside the engine.

Between the intermediate case 17 and the mounting ring 22 an outer fan duct 24 is mounted whose role is to contain and guide, over its external surface, the secondary air stream flowing outside the core of the turbojet engine 10, but also to take up the thrust forces between the mounting ring 22 and the intermediate case 17 to which the other mount of the turbojet engine 10 is connected.

According to the invention, a radial modular arm 25 for the connection of ancillaries, is arranged between the outer fan duct 24 and the inner fan duct 23. Its role is to ensure the continuity between ancillaries positioned outside the outer fan duct 24 and others positioned inside the inner fan duct 23.

With reference to FIG. 4, the modular arm 25 comprises a metal sheet 26 that is globally rectangular and slightly incurved, in which a recess 27 is made here of oval shape. In the recess 27 orifices 28 are pierced for passing tubing elements 29 that here total ten in number. More precisely, in each orifice 28 a tubing element 29 may be inserted and fixed, for example by bolting, at this orifice 28 as will be seen in more detail below. The tubing elements 29 here are metallic.

Each tubing element 29 is a service connection between an ancillary outside the outer duct 24 and its extension inside the inner fan duct 23. Each tubing element 29 is calibrated in relation to the ancillary for which it ensures a connecting function. The diameter of orifice 28 is calibrated with respect to the tubing element 29 it receives.

By inner or outer in respect of a part, of part thereof, is meant hereinafter a portion which, once mounted, is positioned respectively radially inwardly or outwardly of the turbojet engine 10.

With reference to FIG. 5, each tubing element 29 comprises a positioning and sealing skirt 31 which is integral therewith and intended to abut the inner surface of recess 27. Hence when mounting the modular arm 25, each tubing element 29 is inserted via its end the closest to skirt 31, into its intended orifice 28 until the skirt 31 comes to abut the inner surface of the recess 27. A nut 30 is then screwed onto a thread of the tubing element 29 provided for this purpose on the outer side of the recess 27 holding tubing element 29 in its orifice 28 between the nut 30 and the skirt 31. Other intermediate positioning or sealing parts, in particular on the outer side of the recess 27, may be provided. At the end the closest to skirt 31, and beyond nut 30, the tubing elements 29 comprise connection means 50 to an ancillary, for example a thread 50 as here on the tubing element 29 under consideration. These connection means 50 make it possible to connect the ancillary outside the outer fan duct 24, which needs to be connected with an ancillary inside the enclosure defined by the inner fan duct 23, to the tubing element 29 which was previously sized to ensure this connection.

All the tubing elements 29 are fixed in their respective orifice 28. The same number of orifices 28 are provided as there are tubing elements 29. If this were not the case, the unused orifices 28 would need to be plugged. In the embodiment shown of the invention, the tubing elements 29 comprise a bend 32 in the vicinity of the skirt 31 and extend globally rectilinear fashion either side of this bend 32. The tubing elements 29 all have the same shape except for their diameter and therefore all extend parallel to one another once mounted.

With reference to FIG. 6, the removable modular arm 25 of the invention also comprises a shaped jacket 33. The jacket 33 comprises a jacket body 34 of globally oval section, corresponding to the oval shape of the recess 27, and elongated to adapt to the distance between the inner fan duct 23 and the outer fan duct 24. The jacket 33 is hollow and open on both sides and comprises an outer edge 35, globally perpendicular to the jacket body 34 whose shape corresponds to the shape of metal sheet 26.

The oval shape is initially related to the oval shape it is desired to impart to the jacket 33 of the modular arm 35. Once the turbojet engine is mounted, the jacket 33 extends between the inner fan duct 23 and the outer fan duct 24, therefore in the secondary air stream, so that its shape must be adapted in relation to the flow of the secondary air stream about it. The oval shape may evidently be replaced by any other suitable shape.

With reference to FIG. 7, but also to FIG. 5, the modular arm 25 of the invention, once assembled, comprises the metal sheet 26 on which the tubing elements 29 are fixed, around which the shaped jacket 33 is fitted whose shape adapts to the whole. The edge 35 of the jacket 33, as seen previously, is arranged to follow the contour of the inner surface of the metal sheet 26, the recess 27 of the metal sheet, on the inner side from which it protrudes, being set in the body 34 of jacket 33 that is sized for this purpose. The jacket 33 is made integral with the metal sheet 26, by welding or brazing for example, to form both with the sheet and with tubing elements 29 the modular arm 25 of the invention. Once the arm 25 is assembled, the tubing elements 29 project, opposite sheet 26, outside the enclosure defined by the jacket 33.

With reference to FIG. 8, the inner fan duct 23 comprises a plurality of panel-supporting longitudinal plates 36, here totalling four, which together with other maintaining elements such as a ring 37 form the frame of the inner fan duct 23. With reference to FIG. 10, the inner fan duct 23 is formed when the panels 38 are positioned between the successive panel supports 36, wedged in cut-outs 47 provided for this purpose, thereby creating the required surface area for encasing the core of the turbojet engine 10 and guiding the secondary air stream.

On the panel supports 36, in the central part which is not in contact with the panels 38, a bedplate 39 is arranged to receive a modular arm 25 for connecting ancillaries. Said bedplate 39 comprises a longitudinal hollow 40 forming a shoulder 41 which follows a globally oval contour corresponding to the section of the inner end of the jacket 33 of modular arm 25.

With reference to FIG. 9, the hollow 40 is pierced with a plurality of channels 42, here totalling ten, to receive and connect tubing elements 29 of the modular arm 25 of the invention. Each channel 42 comprises a portion 43 opening onto the surface of the hollow 40, here shown in a front view perpendicular to this surface, a bend 51 and a portion 44 parallel to the surface of the hollow 40, hence perpendicular to the first portion 43 leading into a longitudinal side wall of support 36 in which channel 42 is pierced. In the preferred embodiment of the turbojet engine 10 of the invention, two parallel rows of five channels 42 are pierced in hollow 40, the channels 42, according to the row to which they belong, leading into one or other of the side longitudinal walls of the support 36. Evidently, instead of opening onto the side surfaces of the support 36, the channels 42 could open onto the inner surface.

It is possible, at portion 44 of a channel 42 opening onto the side part of support 36 duly sized, to connect an ancillary 45 positioned inside the enclosure defined by the inner fan duct 23. Connections 46, well known to persons skilled in the art, may be provided for this purpose on support 36. The connections 46 and the channels 42 are evidently sized in relation to the ancillary for which they must act as connection.

Each channel 42 is sized, in its portion 43 opening onto the surface of hollow 40, to receive the end of a tubing element 29. The latter may be provided with an O-ring seal 48. In the example of the embodiment of the invention described here, the ten channels 42 are sized to each receive the end of the tubing element 29 of the modular arm 25 corresponding to their position.

The distribution and the diameter of the channels 42 on the surface of the hollow 40 of support 36 are comparable to the distribution and diameter of the orifices 28 on the surface of the recess 27 of the modular arm 25. The bedplate 39 is exactly arranged and designed to receive a particular modular arm 25: its channels 42 are arranged to receive the tubing elements 29 whilst the shoulder 41 of the hollow 40 is arranged to support the inner end of body 34 of jacket 33.

The mounting of the ancillaries and their connection between the outer fan duct 24 and the inner fan duct 23 of the turbojet engine 10 of the invention will now be described in more detail, using the example of a connection via a single modular arm 25.

Panel supports 36 of the inner fan duct 23 of turbojet engine 10 are mounted around the core of the turbojet engine 10, between the inner base 19 of the arms 18 of the intermediate case 17 and the exhaust case 21. The ancillaries, extending inside the enclosure to be defined by the inner fan duct 23 and intended to be connected with ancillaries positioned outside the outer fan duct 24, are then connected to their intended portions 43 of channels 42 on connections 46 provided for this purpose of support 36 on which bedplate 39 is arranged to receive modular arm 25.

This internal connecting being accomplished, it is possible to place the panels 38 on their supports 36 and to thereby form the inner fan duct 23. The outer fan duct 24 is then mounted between the intermediate case 17 and the mounting ring 22.

The modular arm 25 is then caused to slide through oval-shaped orifice 49 provided for this purpose on the outer fan duct 24, between the latter and the inner fan duct 23. The orifice 49 is positioned perpendicular to the bedplate 39 so that it is possible just by inserting arm 25 through opening 49 to insert the ends of tubing elements 29 in portions 43 of channels 42 of bedplate 39 intended to receive the same, without the need to access the space defined by the inner fan duct 23 and the outer fan duct 24. The metal sheet 26 of arm 25 is then fixed removable fashion to the outer fan duct 24, for example by means of inserts or any other suitable means. It could also be brazed which would however render the dismounting operation of arm 25 more delicate.

The ancillaries extending outside the outer fan duct 24 which are to be connected to the above-mentioned inner ancillaries may then be connected to the connection means 50 of the tubing elements 29, the choice evidently being related to the ancillary already connected to each tubing element 29 via bedplate 39.

Therefore, by means of modular arm 25 of the invention, the connection of ancillaries between the outer fan duct 24 and the inner fan duct 23 is ensured, the arm 25 in co-operation with bedplate 39 and orifice 49 of the outer fan duct 24 making it possible to ensure connection of the ancillaries. This connection can be easily mounted and dismounted without having to dismount the internal connections in particular those made at the side walls of supports 36.

Evidently, several assemblies of arm 25, bedplate 39 and orifice 49 may be provided on different panel supports 36 of the inner fan duct 23, or even on one same support 36 for example along this support.

In the described embodiment of the turbojet engine 10 of the invention, the modular arm 25, its orifices 28 for passing tubing elements 29, the tubing elements 29 and their connections 50, channels 42 and their connections 46 are calibrated with respect to the ancillaries they are intended to connect. Evidently all these elements could be calibrated standard fashion, the connections 46, 50 or other connections enabling adaptation as per the type and gauge of the ancillary systems which are to be connected.

The invention claimed is:

1. A turbofan jet engine, comprising:

an outer fan duct, an inner fan duct arranged inside said outer fan duct, a core that includes a compressor and a combustion chamber, said core being arranged inside said inner fan duct, wherein said inner fan duct and said outer fan duct are arranged so as to contain and guide, during operation of said engine, a secondary air stream flowing outside said core between said inner and outer fan ducts, fluid-conveying ancillaries positioned outside the outer fan duct, fluid-conveying ancillaries positioned inside the inner fan duct, and a modular arm arranged inside said outer fan duct and between said outer fan duct and said inner fan duct so as to extend across said secondary air stream flowing between the inner and outer fan ducts during operation of the engine, wherein said modular arm provides a connection between said fluid-conveying ancillaries positioned outside the outer fan duct and said fluid-conveying ancillaries positioned inside the inner fan duct, wherein, the inner fan duct comprising panels and panel supporting longitudinal plates, at least one panel supporting longitudinal plate comprises a bedplate to receive said modular arm.

2. A turbofan jet engine as in claim 1, wherein the outer fan duct comprises at least one orifice for passing said modular arm.

3. A turbofan jet engine as in claim 1, wherein said modular arm comprises tubing elements provided with external connection means to ancillaries, and is configured to be inserted in channels opening onto an outer surface of the bedplate.

4. A turbofan jet engine as in claim 3, wherein the channels also open onto at least one different surface of the bedplate and comprise connection means to ancillaries.

5. A turbofan jet engine as in claim 3, wherein the outer surface of the bedplate comprises a hollow, for receiving the modular arm, in which the channels are pierced.

6. A turbofan jet engine as in claim 1, wherein said modular arm includes a plurality of tubular elements that are substantially parallel to each other over a distance separating the inner fan duct to the outer fan duct.

7. A turbofan jet engine as in claim 1, wherein said modular arm includes a plurality of tubular elements that extend substantially straight and radially over a distance separating the inner fan duct to the outer fan duct.

* * * * *